US006664513B1

(12) United States Patent
Park

(10) Patent No.: US 6,664,513 B1
(45) Date of Patent: Dec. 16, 2003

(54) WALL-MOUNTED MIRROR HEATED BY CONVECTION AND RADIATION

(75) Inventor: Hubert Park, Fountain Valley, CA (US)

(73) Assignee: Parkson Industries, Inc., Fountain Valley, CA (US)

( * ) Notice: Subject to any disclaimer, the term of this patent is extended or adjusted under 35 U.S.C. 154(b) by 0 days.

(21) Appl. No.: 10/154,552

(22) Filed: May 25, 2002

(51) Int. Cl.[7] ..... H05B 3/00
(52) U.S. Cl. ..... 219/219; 392/435
(58) Field of Search ..... 219/219, 522, 219/541, 203, 543; 392/435, 436, 432; 359/512–514

(56) References Cited

U.S. PATENT DOCUMENTS

| | | | | | |
|---|---|---|---|---|---|
| 1,933,173 | A | * | 10/1933 | Hunt | 219/219 |
| 2,103,384 | A | * | 12/1937 | Somohano | 219/219 |
| 2,495,788 | A | * | 1/1950 | Trist | 392/435 |
| 2,797,287 | A | * | 6/1957 | Prutzman | 219/219 |
| 2,803,733 | A | * | 8/1957 | Kashirsky | 219/219 |
| 2,815,433 | A | * | 12/1957 | Zumwalt | 219/219 |
| 4,940,317 | A | | 7/1990 | Reuben | |
| 5,155,334 | A | | 10/1992 | Marstiller et al. | |
| 5,302,809 | A | | 4/1994 | Ghiassy | |
| 5,380,981 | A | | 1/1995 | Feldman et al. | |
| 5,406,049 | A | | 4/1995 | Reiser et al. | |
| 5,414,242 | A | * | 5/1995 | Kwong | 219/219 |
| 5,731,569 | A | | 3/1998 | Crescenzo | |
| 5,904,874 | A | | 5/1999 | Winter | |
| 6,198,073 | B1 | | 3/2001 | Gonzalez | |
| 6,365,876 | B1 | | 4/2002 | Park | |

FOREIGN PATENT DOCUMENTS

| | | | | |
|---|---|---|---|---|
| DE | 2530937 | * | 1/1977 | 219/219 |
| DE | 2742018 | * | 12/1978 | |
| GB | 868315 | * | 5/1961 | |
| GB | 1414905 | * | 11/1975 | 219/219 |
| GB | 2054329 | * | 2/1981 | |
| KR | 98074166 | * | 11/1998 | |

* cited by examiner

*Primary Examiner*—John A. Jeffery
(74) *Attorney, Agent, or Firm*—Edward Gray

(57) ABSTRACT

A wall-mounted mirror which can be convectively and radiatively heated to prevent fogging by a sheet heater separated from the mirror interior surface by an air gap. The mirror is electrically insulated and grounded to prevent electric shock.

6 Claims, 5 Drawing Sheets

WALL-MOUNTED MIRROR HEATED BY CONVECTION AND RADIATION

BACKGROUND OF THE INVENTION

1. Field of the Invention

This invention relates to mirrors such as are installed on bathroom walls, and more particularly to a mirror heated convectively and radiatively to a temperature exceeding ambient temperature to prevent fogging when water vapor is in the air.

2. Description of the Related Art

Devices for electrically heating and thereby defogging mirrors in warm and humid environments such as bathrooms have been disclosed in many patents. U.S. Pat. No. 4,665,304 to A. G. Spencer provides an extensive survey of the U.S. patent literature up to 1984. More recent U.S. patents disclosing heated mirrors are U.S. Pat. No. 4,940,317 to R. Reuben, U.S. Pat. No. 5,155,334 to J. A. Marstiller et al., U.S. Pat. No. 5,302,809 to A. Ghiassy, U.S. Pat. No. 5,380,981 to B. Feldman et al., U.S. Pat. No. 5,406,049 to C. Reiser et al., U.S. Pat. No. 5,731,569 to G. Crescenzo, U.S. Pat. No. 5,821,501 to H. Zorn, U.S. Pat. No. 5,904,874 to J. Winter, and U.S. Pat. No. 6,198,073 B1 to F. Gonzalez.

Electrical heating of a mirror is accomplished in all these references by a device rigidly attached to or otherwise in good thermal contact with the mirror so that heating occurs by conduction. In contrast, my U.S. Pat. No. 6,365,876 B1 discloses a wall-mounted cabinet having a pivotable door with opposed exterior and interior mirrors which are convectively and radiatively heated by a sheet heater disposed between the two mirrors and separated from each mirror by an air gap. The present invention uses the same technique to heat a single wall-mounted mirror.

Self-heated rear view mirrors for automotive vehicles such as cars and trucks are also known. GB1414905 to R. G. Gray discloses a mirror assembly having a mirror glass and a cover glass spaced apart by a peripheral seal to form a cavity between the two glasses which is filled with an inert gas. An electrical heating element is mounted in the cavity for demisting the glasses. The heating element is in the form of a coiled filament adjacent to the lower edge of the glasses. U.S. Pat. No. 2,797,287 to P. E. Prutzman discloses mirror assemblies, particularly for trucks, incorporating two resistance-wire coils mounted on a stiff asbestos board. Because the coils are in the major lower portion of the mirror casing, that portion is heated primarily by radiant heat while the casing upper portion is heated primarily by convection and conduction.

OBJECTS OF THE INVENTION

In view of the limitations of the related art, it is an object of the present invention to provide a wall-mounted mirror which can be defogged by a sheet heater separated from the mirror by an air gap.

Another object of the invention is to provide a mirror assembly which is protected against electrical shock.

A further object of the invention is to provide a mirror assembly that can be easily manufactured using high quality components.

Yet another object of the invention is to provide a mirror which can be reliably defogged in a warm, humid environment.

Other objects of the invention will become evident when the following description is considered with the accompanying drawing figures. In the figures and description, numerals indicate the various features of the invention, like numerals referring to like features throughout both the drawings and description.

SUMMARY OF THE INVENTION

These and other objects are achieved by the present invention which provides a wall-mounted mirror assembly including a frame having parallel top and bottom portions and parallel left and right portions orthogonal to the top and bottom portions, the four portions determining a rectangular aperture. The assembly further includes a mirror having parallel exterior and interior surfaces bounded by top, left, bottom and right edges coated with a layer of electrically non-conductive material. The bottom edge is closely received within and attached to a J-shaped metallic sheeting, and the interior surface is circumferentially attached to the four frame portions. The assembly further includes a rectangular sheet heater including a blanket with opposed electrically non-conductive first and second surfaces, and a bottom edge proximate to which are attached two electrical terminals. The blanket first surface is separated by an air gap from the mirror interior surface.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENT

Figure 1:
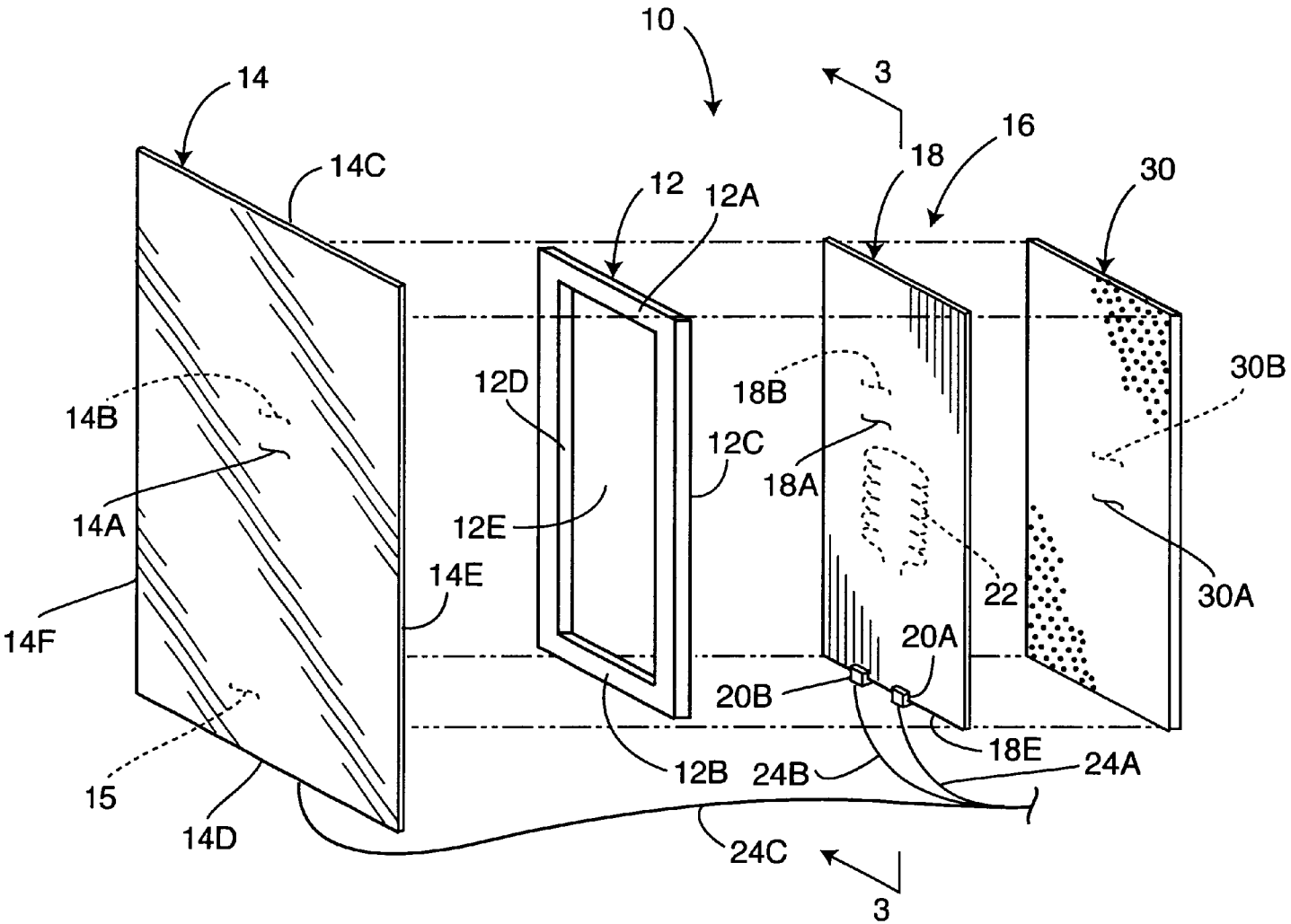
FIG. 1 is an exploded perspective view of a wall-mounted mirror assembly according to the invention, including an electrically insulated mirror attached to a frame and separated by an air gap from an electrical sheet heater attached to the frame and backed by a thermally insulating sheet.
Figure 2:
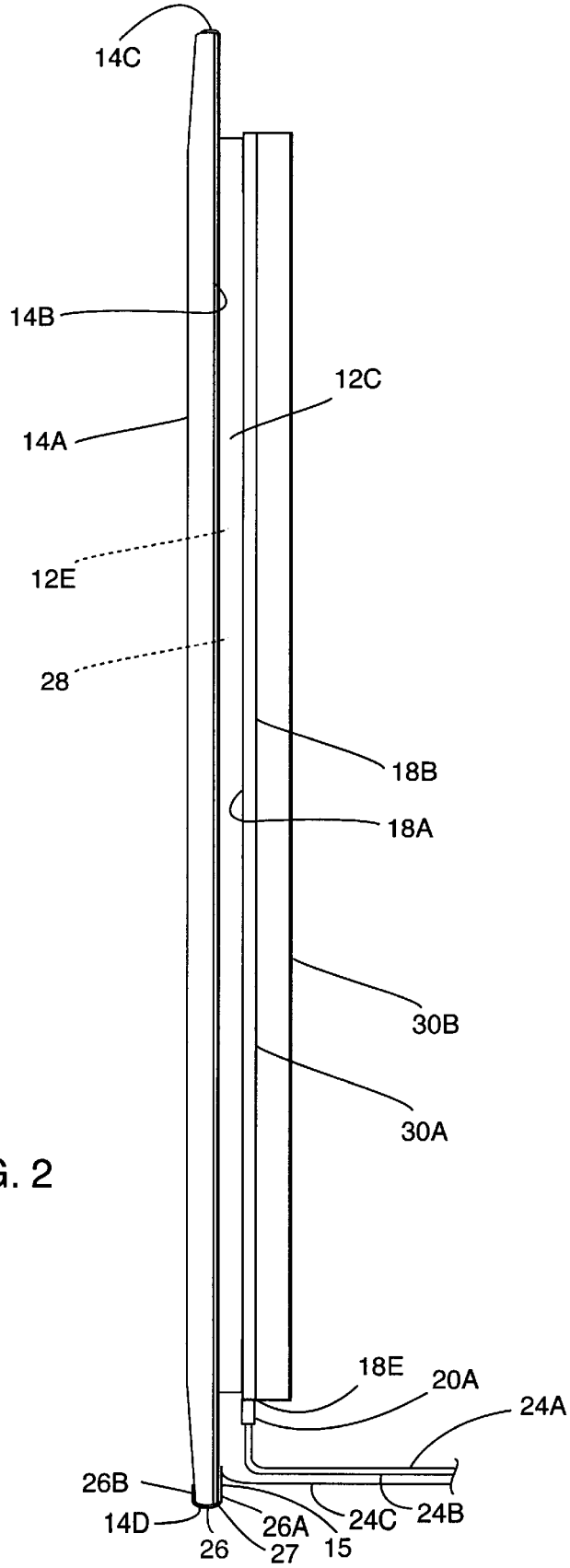
FIG. 2 is a side elevational view of the FIG. 1 assembly showing the mirror, frame, heater and insulating sheet.
Figure 3:
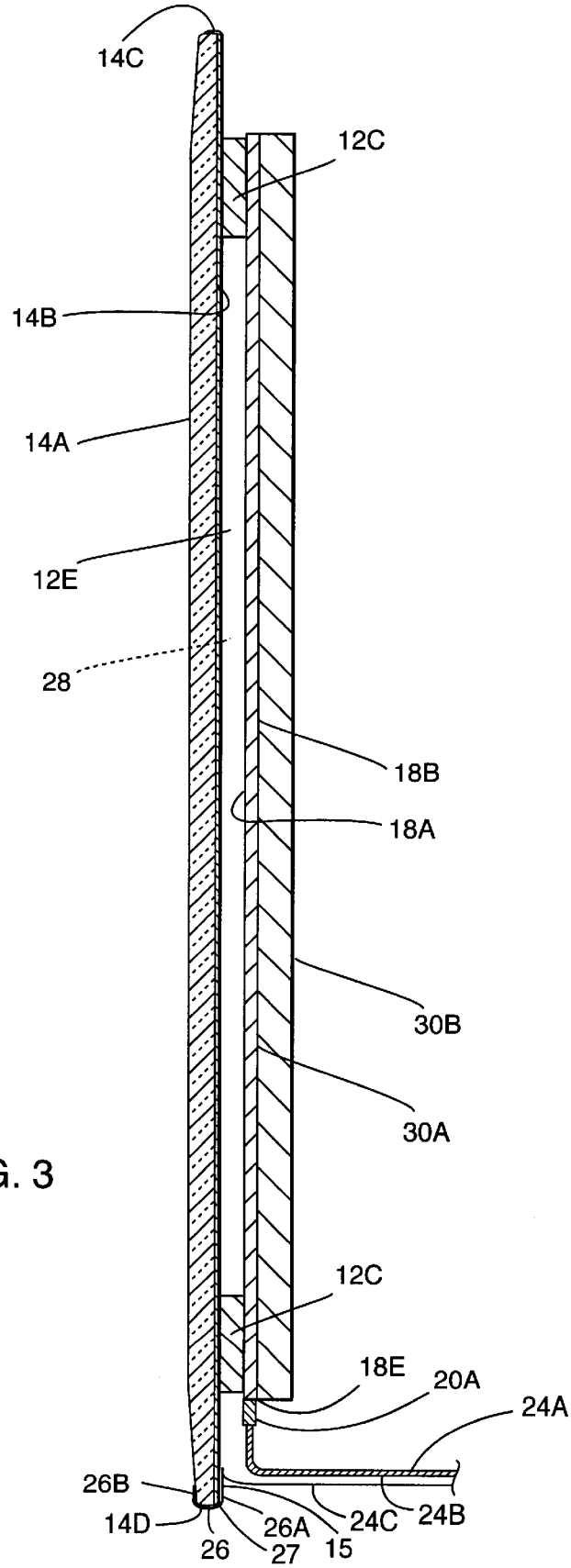
FIG. 3 is a cross-sectional view of the FIG. 1 assembly through the lines 3—3.
Figure 4:
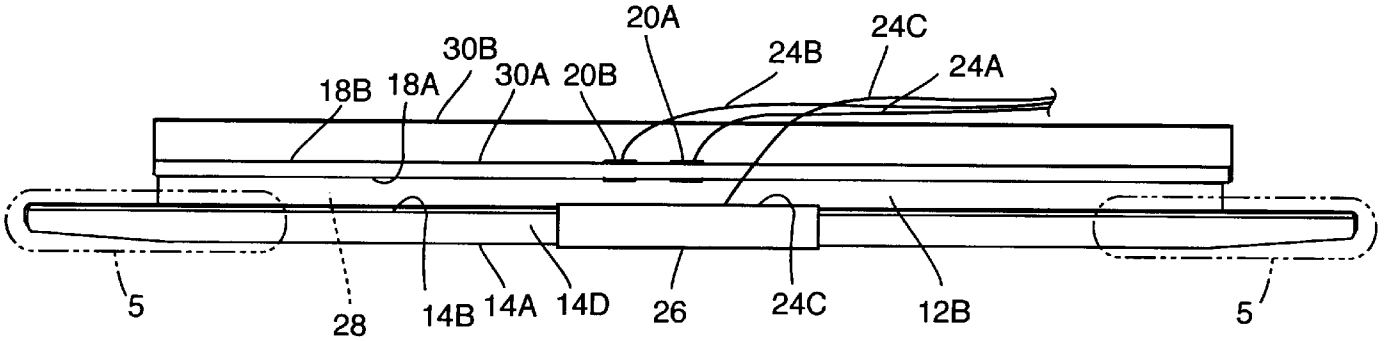
FIG. 4 is a bottom plan view of the FIG. 1 assembly.

While the present invention is open to various modifications and alternative constructions, the preferred embodiment shown in the drawings will be described herein in detail. It is to be understood, however, there is no intention to limit the invention to the particular form disclosed. On the contrary, it is intended that the invention cover all modifications, equivalences and alternative constructions falling within the spirit and scope of the invention as expressed in the appended claims.

Where used herein, the word "attached" means that the two parts referred to are either fabricated in a single piece, or bonded, screwed, soldered or clamped together. However, other forms of attachment may be suitable, consistent with simplicity of manufacture and reliability of operation.

Referring to FIGS. 1, 2, 3 and 4, a mirror assembly 10 according to the invention includes a generally rectangular frame 12 having generally planar, generally parallel top and bottom portions 12A, 12B, respectively, and generally planar, generally parallel left and right portions 12C, 12D, respectively, generally orthogonal to portions 12A, 12B. The four portions determine a generally rectangular aperture 12E. Assembly 10 further includes a mirror 14 having an exterior surface 14A, an interior surface 14B having a lowermost portion 15, top and bottom edges 14C, 14D, respectively, and left and right edges 14E, 14F, respectively. Surface 14B is circumferentially attached to frame portions 12A, 12B, 12C, 12D. Preferably, the mirror is about 3 to 4 millimeters (mm) in thickness. Assembly 10 further includes a thin, generally rectangular sheet heater 16 including a blanket 18 with opposed electrically non-conductive first and second surfaces 18A, 18B, respectively, and a bottom edge 18E proximate to which are attached first and second electrical terminals 20A, 20B. Surface 18A is circumferentially attached to the frame portions 12A, 12B, 12C, 12D. Preferably, frame 12 is made from an aluminum alloy, wood or a plastic, and has a thickness such that the air gap between mirror surface 14B and blanket surface 18A is about 1.0 to about 4.5 mm. Heater 16 further includes a resistive heating element 22 attached to terminals 20A, 20B which preferably is made of NICHROME# wire having a thickness between 0.25 and 0.30 mm. Blanket 18 is made from a silicone rubber material and has a thickness in a range from about 0.35 to about 0.5 mm. A positive (hot) wire 24A carrying 110–120 volt alternating current is attached to terminal 20A, a negative (neutral) wire 24B is attached to terminal 20B, and a ground wire 24C is attached to a rear portion 26A of a "J"-shaped thin metallic sheeting 26, arcuately extending in a front portion 26B, which closely receives and is attached to bottom edge 14D and lowermost portion 15 of mirror interior surface 14B by a thin layer 27 of electrically conductive adhesive (see FIG. 2). Preferably, sheeting 26 is about 10 centimeters (cm) in width, portion 26A is about 22 to 23 mm in length, and portion 26B is about 3 mm in length. Preferably, the sheeting is aluminum about 0.4 to 0.6 mm in thickness. Because heater 16 is isolated from mirror 14 by air gap 28, the mirror is heated convectively and by direct radiation, rather than conductively as in all of the related art devices. Assembly 10 further includes a generally planar, generally rectangular sheet 30 made of a thermally insulating material, which is generally congruent to heater 16. Sheet 30 has first and second surfaces 30A, 30B, respectively. Preferably, sheet 30, which also is rigid and electrically non-conductive, is made of fiberglass and has a thickness in a range from about 1.6 to about 3.2 mm. Sheet 30, attached to heater 16 by juxtaposing and bonding surfaces 18B and 30A, minimizes heat loss due to rearward radiation.

Figure 5:
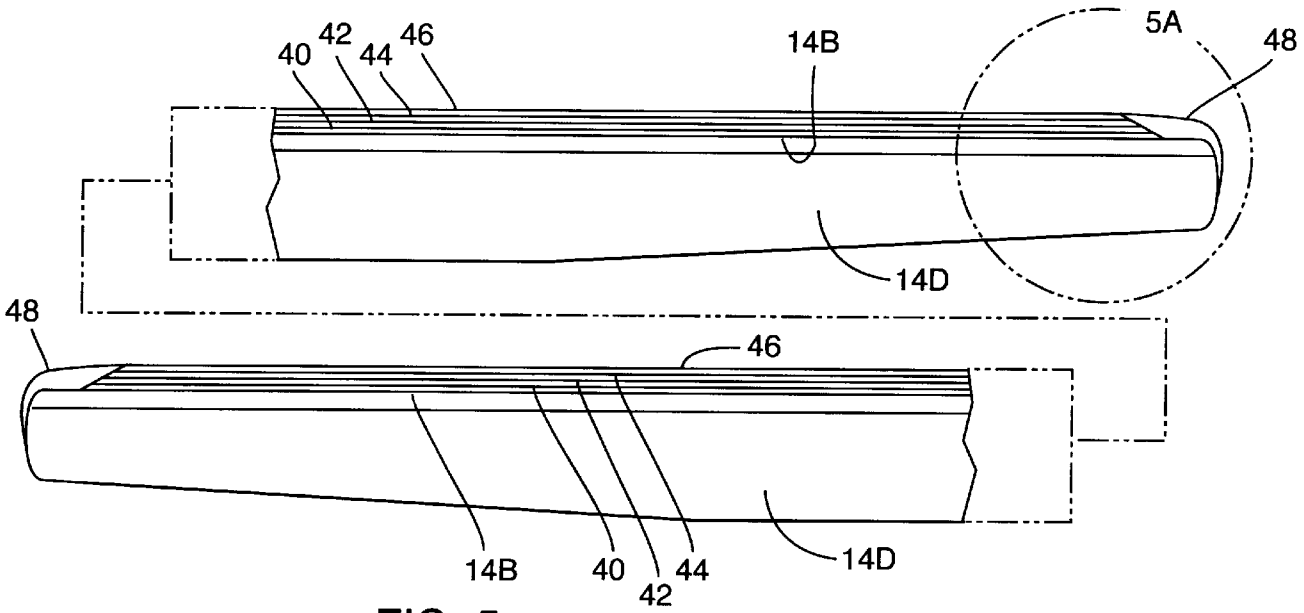
FIG. 5 is an enlarged detail view of the oval regions "5" in FIG. 4, showing stannous chloride, silver nitrate, copper sulfate, and protective paint coatings on the interior surface of the mirror, and an electrically non-conductive coating at the mirror edge.
Figure 5A:
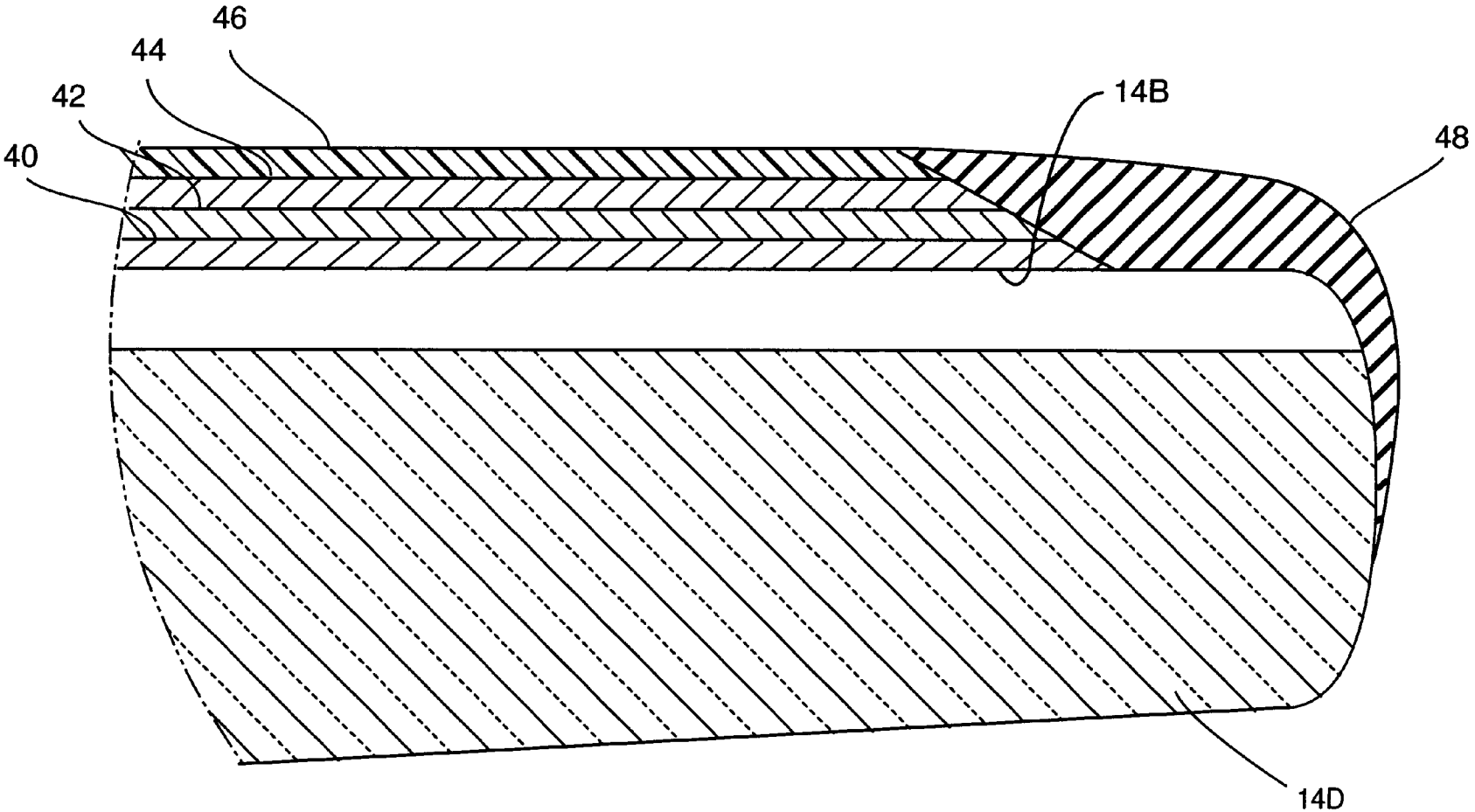
FIG. 5A is a further enlarged detailed view of FIG. 5.

Referring to FIGS. 5 and 5A, a first coating 40 of stannous chloride is attached to interior surface 14B of mirror 14, followed by a second coating 42 of silver nitrate, a third coating 44 of copper sulfate, and a fourth coating 46 of protective paint. Mirror edges 14C, 14D, 14E and 14F are each coated with a layer of electrically non-conductive material 48. Circumferential layer 48 and ground wire 24C make it unlikely that a person touching the mirror would receive an electric shock. However, since contiguous metallic coatings 40, 42 and 44 are in effect one plate of a capacitor, and heating element 22, although electrically insulated, could become through leakage an opposed plate, a person touching the mirror conceivably might receive an electrostatic shock. The combination of sheeting 26 which acts as a grounding plate, and adhesive layer 27 prevents this possibility.

What is claimed is:

1. A wall-mounted mirror assembly comprising:

a frame having generally planar, generally parallel top and bottom portions and generally planar, generally parallel left and right portions orthogonal to the top and bottom portions, the top, left, bottom and right portions determining a generally rectangular aperture;

a mirror having an exterior surface and an interior surface with a lowermost portion, the surfaces generally parallel and bounded by top, left, bottom and right edges coated with a layer of electrically non-conductive material, the bottom edge and said lowermost portion closely received within and attached to a J-shaped metallic sheeting by a layer of electrically conductive adhesive, the interior surface circumferentially attached to the top, left, bottom and right frame portions; and a generally rectangular sheet heater comprising a blanket of a predetermined thickness with opposed electrically non-conductive first and second surfaces, and a bottom edge proximate to which are attached first and second electrical terminals, the blanket first surface separated by a preselected air gap from the mirror interior surface.

2. The mirror assembly of claim 1, wherein:

the sheet heater further comprises a resistive heating element made from a resistive wire and attached to the first and second electrical terminals, the heater blanket is made of a silicone rubber, the heater blanket thickness is in a range from about 0.35 to about 0.5 millimeters, and the air gap between the blanket first surface and the mirror interior surface is in a range from about 1.0 to about 4.5 millimeters; and the J-shaped sheeting is made of aluminum and has a thickness in a range from about 0.4 to about 0.6 millimeters.

3. The mirror assembly of claim 2, wherein the first and second heater electrical terminals are attached, respectively, to positive and negative wires carrying 110–120 volt alternating current, and the sheeting is attached to a ground wire.

4. The mirror assembly of claim 3, further comprising a thermally insulating sheet of a preselected thickness with opposed generally planar first and second surfaces, the first surface attached to the blanket second surface.

5. The mirror assembly of claim 4, wherein the thickness of the thermally insulating sheet is in a range from about 1.6 to about 3.2 millimeters.

6. The mirror assembly of claim 5, wherein the mirror interior surface has attached thereto a first coating of stannous chloride, a second coating of silver nitrate, a third coating of copper sulfate, and a fourth coating of protective paint.

* * * * *